US009345326B2

(12) United States Patent
Sankhgond et al.

(10) Patent No.: US 9,345,326 B2
(45) Date of Patent: May 24, 2016

(54) REFRIGERATOR SHELVES

(71) Applicant: Whirlpool Corporation, Benton Harbor, MI (US)

(72) Inventors: Basavraj Ishwar Sankhgond, Pune (IN); Kirk David Waiz, Newburgh, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 2 days.

(21) Appl. No.: 14/288,637

(22) Filed: May 28, 2014

(65) Prior Publication Data

US 2015/0342350 A1 Dec. 3, 2015

(51) Int. Cl.

| | |
|---|---|
| ***A47B 96/00*** | (2006.01) |
| ***A47B 96/02*** | (2006.01) |
| ***F25D 25/02*** | (2006.01) |
| ***A47B 96/06*** | (2006.01) |

(52) U.S. Cl.

CPC ..... *A47B 96/024* (2013.01); *A47B 96/021* (2013.01); *A47B 96/062* (2013.01); *A47B 96/067* (2013.01); *F25D 25/02* (2013.01); *Y10T 29/49828* (2015.01)

(58) Field of Classification Search

CPC ..... F25D 25/02; F25D 25/024; A47F 5/0018; A47F 5/0068; A47B 96/02; A47B 96/021; A47B 96/025; A47B 96/024; A47B 96/067

USPC ..... 312/404, 408, 351; 211/153, 134; 108/106–108

See application file for complete search history.

(56) References Cited

U.S. PATENT DOCUMENTS

| | | | | |
|---|---|---|---|---|
| 1,684,563 | A * | 9/1928 | Swedman | 62/291 |
| 2,997,356 | A * | 8/1961 | Hilliker et al. | 312/408 |
| 3,221,677 | A * | 12/1965 | Kerr | 108/102 |
| 3,944,080 | A * | 3/1976 | Hansen | B42F 15/0094 211/46 |
| 3,984,163 | A * | 10/1976 | Boorman et al. | 312/408 |
| 6,039,424 | A * | 3/2000 | Pink | A47B 96/16 211/88.01 |
| 6,679,573 | B2 | 1/2004 | Bienick | |
| 7,401,489 | B2 | 7/2008 | Wing | |
| 8,414,095 | B2 | 4/2013 | Stewart | |
| 8,490,801 | B2 * | 7/2013 | Smith et al. | 211/153 |
| 8,820,314 | B1 * | 9/2014 | Johnson et al. | 126/339 |

(Continued)

FOREIGN PATENT DOCUMENTS

| | | | |
|---|---|---|---|
| DE | 102011006257 | A1 | 10/2012 |
| EP | 1236423 | A1 | 9/2002 |

(Continued)

*Primary Examiner* — Janet M Wilkens

(57) ABSTRACT

Refrigerator shelves are disclosed. An example refrigerator shelf includes a substantially planar member, trim along a first edge of the planar member, and a bent continuous wire support rod. The bent rod having a first portion extending along and beneath the trim, a second portion perpendicular to the first portion and extending from the first edge to a point between the first edge and a second edge opposite the first edge, and a third portion extending from the point and extending substantially perpendicularly from a plane defined by the first and second portions.

20 Claims, 5 Drawing Sheets

(56) References Cited

U.S. PATENT DOCUMENTS

| | | | | |
|---|---|---|---|---|
| 2006/0113882 | A1* | 6/2006 | Rioja Calvo | A47B 88/0085 312/348.5 |
| 2008/0067910 | A1* | 3/2008 | Butler | 312/408 |
| 2009/0084914 | A1 | 4/2009 | Picken et al. | |
| 2010/0117502 | A1 | 5/2010 | Kang et al. | |
| 2010/0181884 | A1 | 7/2010 | De La Garza et al. | |
| 2011/0148267 | A1 | 6/2011 | McDaniel et al. | |
| 2011/0164399 | A1* | 7/2011 | Driver et al. | 362/92 |
| 2013/0002117 | A1 | 1/2013 | Picken et al. | |
| 2014/0252937 | A1* | 9/2014 | Lee et al. | 312/404 |
| 2014/0265808 | A1* | 9/2014 | Kendall et al. | 312/408 |
| 2014/0312758 | A1* | 10/2014 | Gossens et al. | 312/404 |
| 2015/0201750 | A1* | 7/2015 | Hopkins | A47B 73/008 211/75 |

FOREIGN PATENT DOCUMENTS

| | | | |
|---|---|---|---|
| EP | 1906121 | A2 | 4/2008 |
| EP | 2423626 | A2 | 2/2012 |
| JP | 2008051484 | A | 3/2008 |
| JP | 2008051485 | A | 3/2008 |

* cited by examiner

REFRIGERATOR SHELVES

FIELD OF THE DISCLOSURE

This disclosure relates generally to refrigerator shelves, and, more particularly, to glass or transparent refrigerator shelves.

BACKGROUND

Most refrigerators have one or more shelves that facilitate the storage of items, such as food items. The shelves may be made of see-through materials such as glass or acrylic, or non-see-through or partially-transparent materials.

SUMMARY

An example refrigerator shelf includes a substantially planar member, trim along a first edge of the planar member, and a bent continuous wire support rod. The bent rod having a first portion extending along and beneath the trim, a second portion perpendicular to the first portion and extending from the first edge to a point between the first edge and a second edge opposite the first edge, and a third portion extending from the point and extending substantially perpendicularly from a plane defined by the first and second portions.

An example method of forming a refrigerator shelf including bending a continuous wire support rod at first and second points to form a first portion of the rod between the first and second points that is sized to extend along a first edge of a substantially planar member, bending the rod at a third point to form a second portion of the rod between the first and third points sized to only partially extend along a second edge of the planar member perpendicular to the first edge, and to form a third portion of the rod extending perpendicularly from a plane defined by the first and second portions, bending the rod at a fourth point to form a fourth portion of the rod between the second and fourth points sized to only partially extend along a third edge of the planar member perpendicular to the first edge, and to form a fifth portion of the rod extending perpendicularly from the plane, and attaching the first portion of the bent rod at the first edge of the planar member thereby forming the refrigerator shelf.

The method may further include attaching trim to the first edge, wherein attaching the first portion of the bent rod at the first edge comprises fitting the first portion of the rod into a feature defined in the trim so the first, second and fourth portions extend substantially parallel to and along a bottom surface of the shelf, and the third and fifth portions extend substantially perpendicularly from the bottom surface.

An example wire support rod for a refrigerator shelf includes first and second bends that define a first portion of the rod between the first and second bends, the first portion sized to extend along a first edge of the shelf, a third bend that defines a second portion between the first and third bends, the second portion sized to only partially extend along a second edge of the shelf perpendicular to the first edge, and defines a third portion extending perpendicularly from a plane defined by the first and second portions, and a fourth bend that defines a fourth portion between the second and fourth bends, the fourth portion sized to only partially extend along a third edge of the shelf perpendicular to the first edge, and defines a fifth portion extending perpendicularly from the plane.

DETAILED DESCRIPTION

In some prior-art refrigerators, glass shelves include a support wire rod beneath and around a perimeter of the shelves in order to comply with and/or meet industry requirements regarding shelf deflection, shelf strength and shelf retention. In many instances, such wire rods require welding during manufacture, which leads to increased labor costs and plant inventory and, thus, results in more expensive shelves. To overcome at least these problems, refrigerator shelves having a single piece of bent wire support rod under only a portion of the shelf perimeter are disclosed that still comply with, meet and/or exceed industry requirements regarding shelf deflection, shelf strength and shelf retention. Disclosed single pieces of bent supply wire rod are each formed from a single continuous piece of support wire rod that is bent and, thus, do not require any welding, thereby lowering costs. Additionally, less wire support rod material is used for each shelf, further reducing costs. Example shelves include the bent wire support rod only underneath and in the vicinity of the front edge of the shelves. The disclosed bent wire support rods provide support against shelf deflection, and engage retention elements of a refrigerator liner to help retain the shelves within a refrigerator.

As used herein, terms such as up, down, top, bottom, side, end, front, back, etc. are used with reference to the normal orientation of an appliance, a compartment in an appliance, an apparatus, a device, an installation, etc. having one of the disclosed shelves. If a shelf is considered with respect to another orientation, it should be understood that such terms would need to be correspondingly modified.

Figure 1:
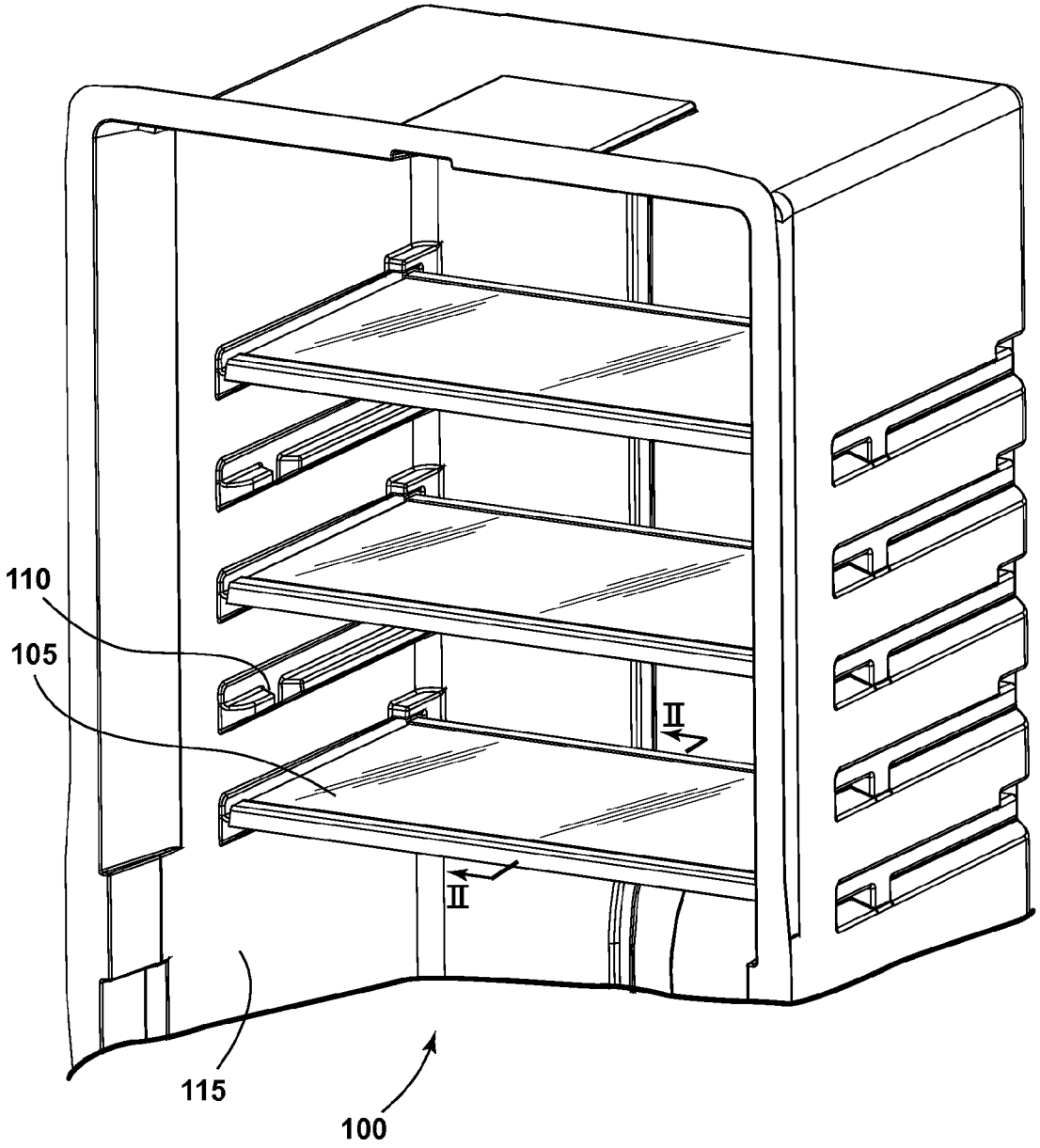
FIG. 1 is an isometric view of an example refrigerator compartment having a refrigerator shelf constructed in accordance with the teachings of this disclosure.

FIG. 1 illustrates an example refrigerated or freezer compartment 100 of, for example, a refrigerator. Example refrigerator configurations include, but are not limited to, a side-by-side refrigerator, a top-freezer refrigerator, a French-door refrigerator, a bottom-freezer refrigerator, etc. The disclosed example shelves may additional and/or alternatively be used in any other appliance including, but not limited to, a freezer, a washing machine, a dryer, a stove, an oven, a microwave, a dishwasher, a shelving unit, a refresher, etc., or in any other apparatus, device, installation, etc. having shelves.

The example compartment 100 of FIG. 1 has an open face to provide access to items present in the compartment 100, and a door (not shown for clarity) moveably mounted for movement between opened and closed positions to selectively open and close the open face of the compartment 100.

To allow items to be stored in the compartment 100, the example compartment 100 of FIG. 1 includes one or more shelves, one of which is designated at reference numeral 105. In the example of FIG. 1, the shelves 105 are moveably positionable within the compartment 100 to allow for the flexible storage of items in the compartment 100. However, the shelves 105 need not be moveably positionable. The example shelves 105 of FIG. 1 are transparent. However, one or more of the shelves 105 may be partially-transparent or opaque.

Ends of the shelves 105 engage rails, one of which is designated at reference numeral 110, defined in and/or a part of the liner 115 of the sidewalls of the compartment 100. The rails 110 support the shelves 105, and have features defined therein, two of which are designated at reference numerals 205 and 210 (see FIG. 2), that retain and/or otherwise prevent the shelves 105 from inadvertently moving out of place. Alternatively, the rails 110 may be affixed to the liner 115 and/or the sidewalls.

Figure 3:
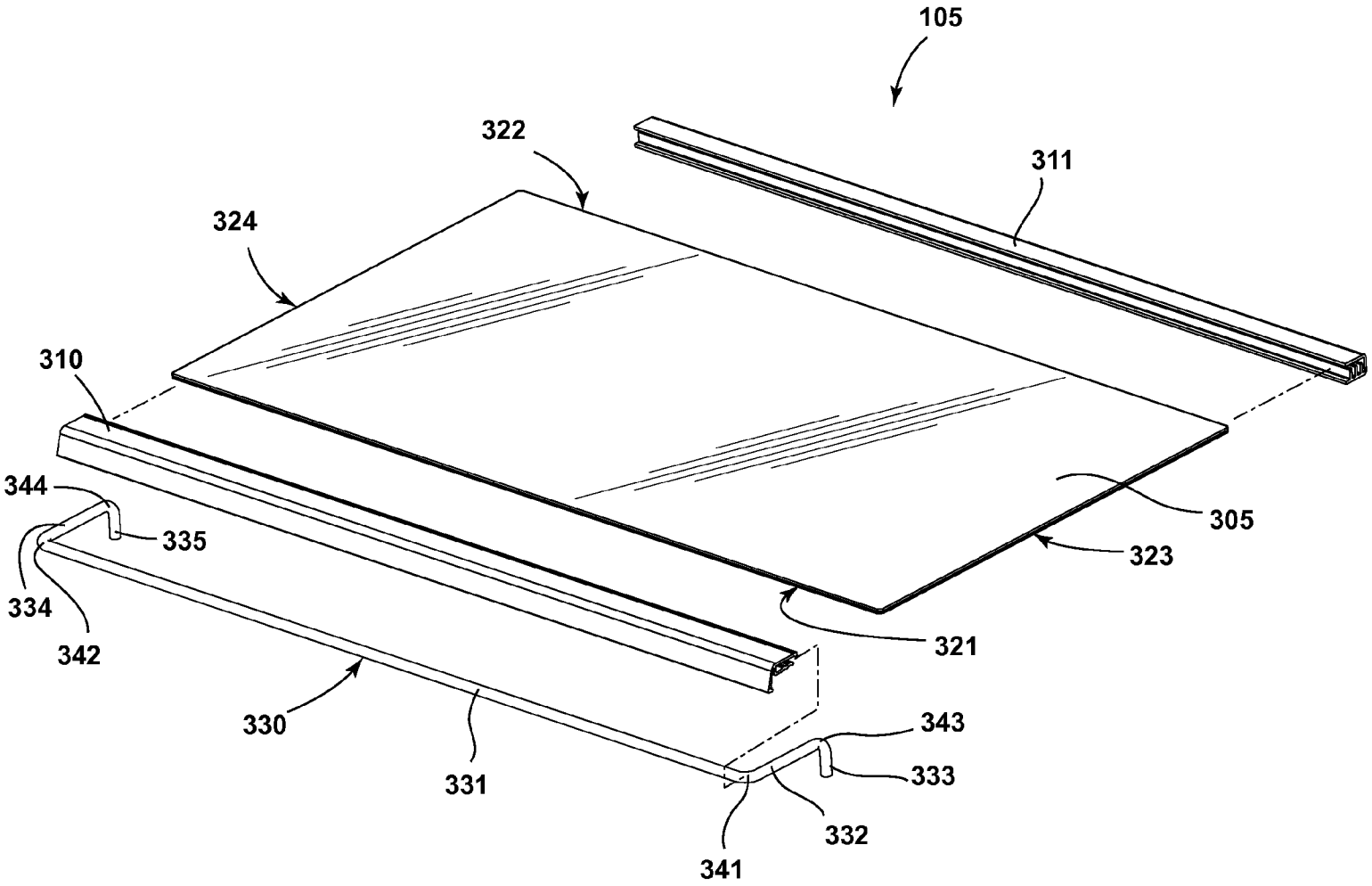
FIG. 3 is an isometric exploded view of the example shelf of FIG. 1.
Figure 4:
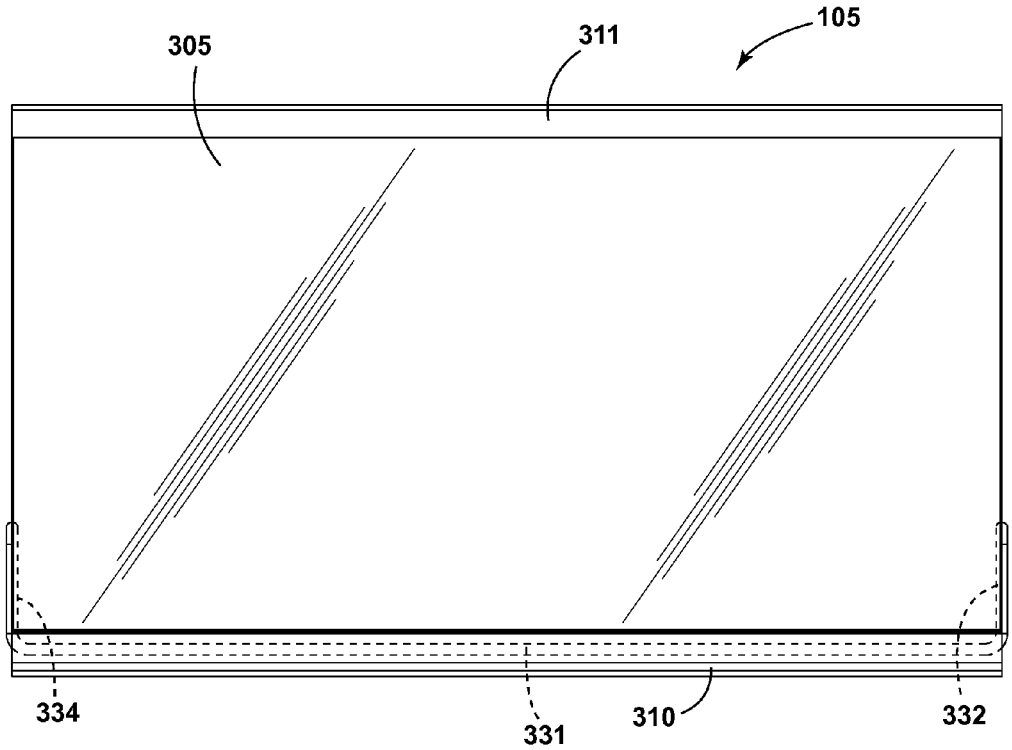
FIG. 4 is a top view of the example shelf of FIG. 1.
Figure 5:
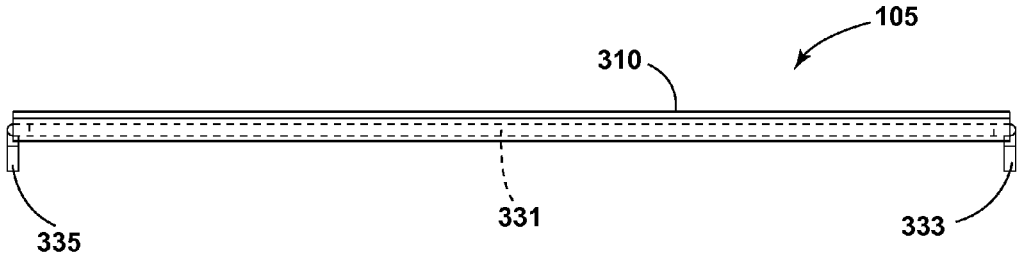
FIG. 5 is a front view of the example shelf of FIG. 1.

Turning to FIG. 3, the example shelves 105 include a transparent planar body 305 formed of, for example, a piece and/or sheet of glass or acrylic. Alternatively, the planar body 305 may be semi-transparent or opaque. The example planar body 305 is substantially planar or flat. However, elements having other shapes may be used instead of the planar body 305. For example, a member having curved or raised edges to retain spilled liquids, a lip to facilitate grasping, etc. may be used. In such examples, the bent support rods disclosed herein could and/or would have additional corresponding bends.

Figure 2:
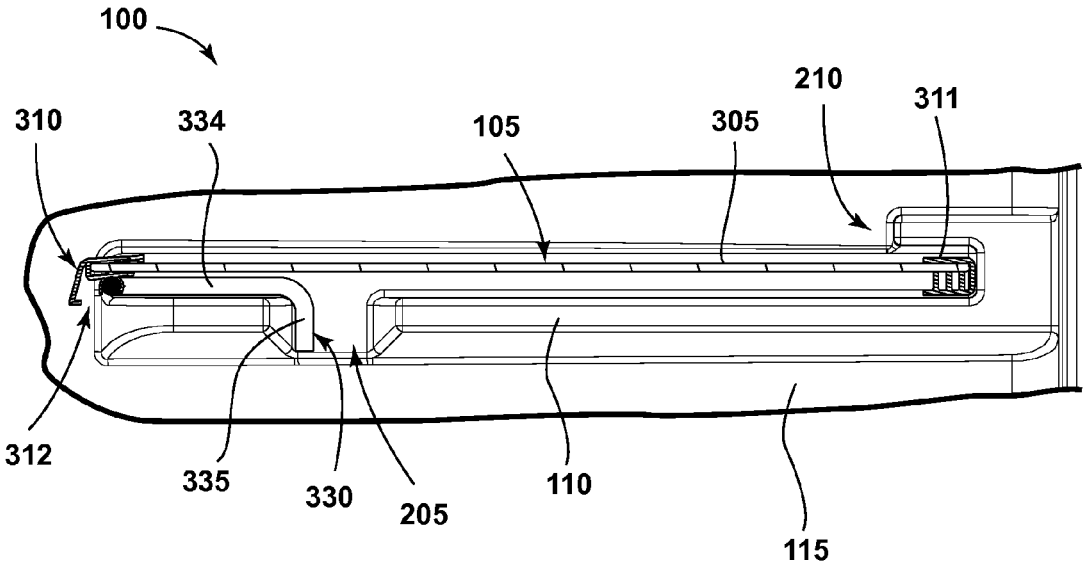
FIG. 2 is a cross-sectional view of the example compartment of FIG. 1 taken along line II-II of FIG. 1.

The example shelves 105 include front trim 310 and back trim 311 that are slip fit, adhered and/or otherwise affixed onto corresponding front and back edges 321, 322 of the planar body 305, as shown in FIG. 2. While not shown in FIG. 3, the shelf 105 may additionally and/or alternatively include trim on end or side edges 323, 324 of the planar body 305. In some examples, a border encompassing all four edges 321-324 of the planar body 305 is used instead of distinct pieces of trim.

The example shelves 105 are supported by a bent wire support rod 330 located along the front edge 321 of the planar body 305. The rod 330 is formed by bending a single continuous piece of support wire rod. For ease of discussion, this disclosure may refer to bending a rod at a point. However, when referring herein to bending a rod at a point, the term "point" is used to identify an area of the rod that is being bent not a precise location, and/or to logically delineate a portion of a bent rod between bends. Moreover, bending of a rod is not limited to any bending technique, method, temperature, procedure, etc.

As shown in FIGS. 2-5, the bent rod 330 has a first portion 331 between the first and second points 341, 342 that is sized to extend along the front edge 321 of the shelf 105; a second portion 332 between the first point 341 and a third point 343; a third portion 333 extending from the third point 343 perpendicularly from a plane defined by the first and second portions 331, 332; a fourth portion 334 between the second point 342 and a fourth point 344; and a fifth portion 335 extending from the fourth point 344 perpendicularly from a plane defined by the first and fourth portions 331, 334.

Figure 2A:
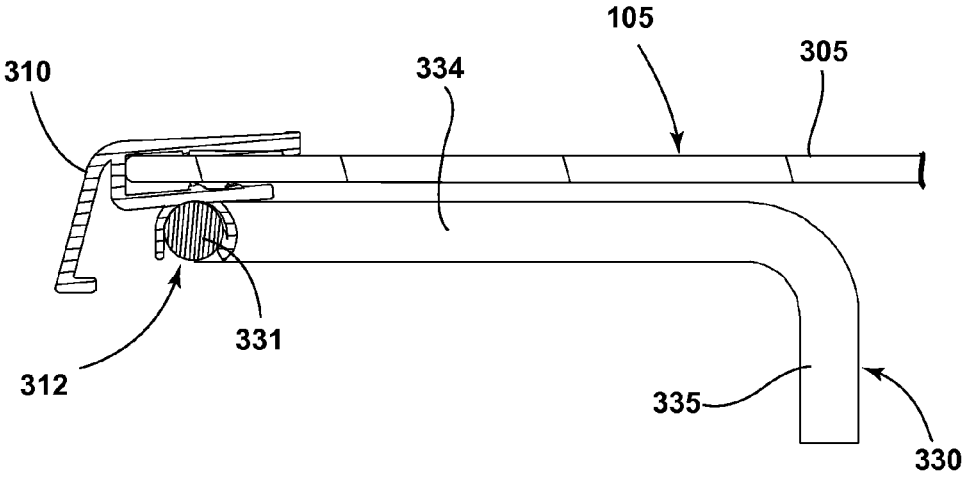
FIG. 2A is an illustration showing a portion of the shelf shown in FIG. 2 in more detail.

The first portion 331 is sized to extend longitudinally along the front edge 320, and as shown clearly in FIG. 2A, the first portion 331 of the rod 330 fits into a feature 312 defined longitudinally along the bottom of the trim 310, or is otherwise attached to the bottom of the trim 310. As shown in FIG. 2A, an example feature 312 comprises two curved protrusions, projections or fins 215, 216 that extend longitudinally along the bottom of the trim 310 forming a U-shaped channel into which portion 331 of the rod 330 may be press fit, snapped and/or otherwise received. Other example features include, but are not limited to, a slot, a groove, a channel, a clip, etc. In some examples, the bent rod 330 is powder coating to match the color of the front trim 310.

As shown clearly in FIGS. 2 and 3, the second and fourth portions 332, 334 of the rod 330 are sized to extend only partially along the side or end edges 323, 324.

As also shown clearly in FIG. 2, the third and fifth portions 333, 335 of the rod 330 engage the features 205 defined in the rails 110 to reduce the ability of the shelf 105 to move forward across the rail 110. As also shown, the trim 311 engages the features 210 defined in the rails 110 to reduce the ability of the shelf 105 to tip forward. If, alternatively, the trim 311 is omitted, the edge 322 of the planar body 305 can engage the features 210.

An exemplary shelf has overall dimensions of 341 millimeters (mm) deep by 626 mm wide, a planar member 305 made of non-shattering or tempered glass (ANSI® Z97.1-1984) with a thickness of 4 mm, a bent rod 330 made of 1008 industrial low carbon steel (ASTM A510M, with a chemical composition of UNS G 10080) and a diameter of 7.2 mm, a length of the portion 331 of approximately 608 mm, a length of the portions 332, 334 of approximately 65 mm, a length of the portions 333, 335 of approximately 25 mm. In laboratory testing, a prototype of this exemplary shelf passed WTM-D-40.97 clause 3.2 for shelf deflection, UL™ 250 for shelf strength, WTM-D-40.153 for shelf retention, and held 41 2.2 lbs UL discs.

Figure 6:
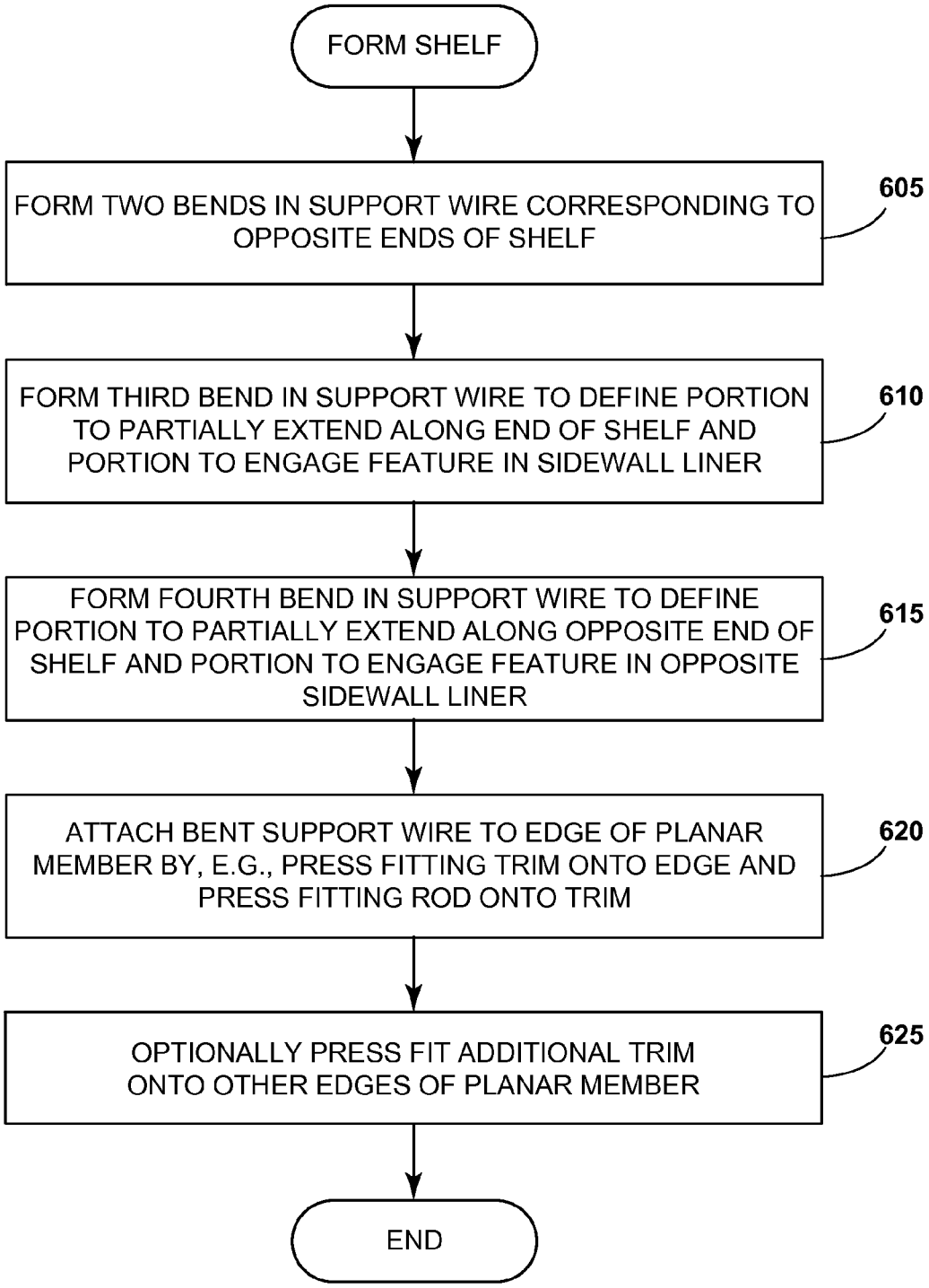
FIG. 6 is a flow chart showing an example process or method of forming the disclosed example shelves.

FIG. 6 is a flowchart of an example process or method that may, for example, be implemented as machine-readable instructions carried out by, for example, manufacturing equipment to form the example shelves disclosed herein. The example process of FIG. 6 begins with a piece of wire support rod 330 being bent at two points 341, 342 (see FIG. 3) to form the example portion 331 (block 605). The support rod 330 is bent at another point 343 to form portions 332, 333 with portion 332 perpendicular to portion 331 and portion 333 perpendicular to the plane defined by portions 331, 332 (block 610). The support rod 330 is bent at yet another point 344 to form portions 334, 335 with portion 334 perpendicular to portion 331 and portion 335 perpendicular to the plane defined by portions 331, 334 (block 615).

The support rod 330 is then attached to a front edge 321 of a planar member 305 (block 620). In some examples, trim 310 is attached to the front edge 321 and the support rod 330 is attached to the trim 310 (block 620). The trim 310 may be extruded and press fit onto the first edge 321 with the first portion 331 of the support rod 330 press fit into a feature defined in the trim 310 (block 620).

In some examples, additional trim 311 is press fit onto other edges of the planar member 305 (block 625).

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A refrigerator shelf comprising:

a substantially planar member;

trim along a first edge of the planar member; and a continuous wire support rod bent from a single piece to have:

a first portion extending along and beneath the trim;

a linear second portion substantially perpendicular to the first portion and extending from the first edge to a point between the first edge and a second edge opposite the first edge; and a third portion extending from the point and extending substantially perpendicularly from a plane defined by the first and second portions.

2. A refrigerator shelf as defined in claim 1, wherein the trim includes a U-shaped channel configured to enable the first portion to be at least one of press fit or snapped into the U-shaped channel.

3. A refrigerator shelf as defined in claim 1, wherein the rod has a first bend at a junction of the first and second portions, and a second bend at a junction of the second and third portions.

4. A refrigerator shelf as defined in claim 1, wherein at least the third portion is dimensioned to engage a retention feature defined in a refrigerator liner.

5. A refrigerator shelf as defined in claim 1, wherein the first and second portions define a plane that is substantially parallel to a bottom surface of the planar member.

6. A refrigerator shelf as defined in claim 1, wherein the first and second portions are substantially parallel to the planar member.

7. A refrigerator shelf as defined in claim 1, further comprising second trim along the second edge.

8. A refrigerator shelf as defined in claim 7, further comprising:

a third edge of the planar member extending from the first edge to the second edge; and third trim along the third edge.

9. A refrigerator shelf comprising a substantially planar member;

trim along a first edge of the planar member; and a continuous wire support rod bent to have:

a first portion extending along and beneath the trim;

a second portion perpendicular to the first portion and extending from the first edge to a point between the first edge and a second edge opposite the first edge, wherein the first and second edges are substantially parallel;

a third portion extending from the point and extending substantially perpendicularly from a plane defined by the first and second portions, wherein:

the planar member further comprises a third edge extending from the first edge to the second edge;

the third edge is substantially perpendicular to the first and second edges; and the point lies on the third edge.

10. A refrigerator shelf as defined in claim 1, wherein the rod further comprises:

a fourth portion that is perpendicular to the first portion, opposite the second portion, and extends from the first edge to a second point between the first edge and the second edge; and a fifth portion extending from the second point and extending substantially perpendicularly from a plane defined by the first and fourth portions.

11. A refrigerator shelf as defined in claim 1, wherein the planar member comprises a substantially flat piece of at least one of glass or acrylic.

12. A refrigerator shelf as defined in claim 1, wherein the planar member comprises a substantially flat piece of an at least partially transparent material.

13. A method of forming a refrigerator shelf including a wire support rod, the method comprising:

bending a continuous wire support rod at first and second points to form first and second bends that define a first portion of the rod between the first and second bends that is sized to extend along and provide support to a first edge of the refrigerator shelf;

bending the rod at a third point to form a third bend that defines a second portion of the rod between the first and third bends that is sized to only partially extend along and provide support to a second edge of the refrigerator shelf perpendicular to the first edge, and to define a third portion of the rod extending perpendicularly from a plane defined by the first and second portions;

bending the rod at a fourth point to form a fourth bend to define a fourth portion of the rod between the second and fourth bends that is sized to only partially extend along and provide support to a third edge of the refrigerator shelf perpendicular to the first edge, and to define a fifth portion of the rod extending perpendicularly from the plane; and attaching the first portion of the bent rod at the first edge of the refrigerator shelf.

14. A method as defined in claim 13, further comprising attaching trim to the first edge, wherein attaching the first portion of the bent rod at the first edge comprises attaching the first portion of the bent rod to the trim so the first, second and fourth portions extend substantially parallel to and along a bottom surface of the shelf, and the third and fifth portions extend substantially perpendicularly from the bottom surface.

15. A method as defined in claim 14, wherein the trim is an extruded trim, and further comprising:

press fitting the trim onto the first edge; and press fitting the first portion of the rod into a feature defined in the trim.

16. A method as defined in claim 15, further comprising press fitting second extruded trim to a fourth edge of the shelf opposite the first edge.

17. A method as defined in claim 16, further comprising press fitting third and fourth extruded trim to respective ones of the second and third edges.

18. A refrigerator shelf including a wire support rod, the rod comprising:

first and second bends that define a first portion of the rod between the first and second bends, the first portion sized to extend along and provide support to a first edge of the shelf;

a third bend that defines a second portion between the first and third bends, the second portion sized to only partially extend along and provide support to a second edge of the shelf perpendicular to the first edge, and defines a third portion extending perpendicularly from a plane defined by the first and second portions; and a fourth bend that defines a fourth portion between the second and fourth bends, the fourth portion sized to only partially extend along and provide support to a third edge of the shelf perpendicular to the first edge, and defines a fifth portion extending perpendicularly from the plane.

19. The refrigerator shelf as defined in claim 18, wherein the third and fifth portions are dimensioned to engage a retention feature defined in a refrigerator liner.

20. The refrigerator shelf as defined in claim 18, wherein the plane defined by the first and second portions is configured to be substantially parallel to a bottom surface of the shelf.

* * * * *